US006620010B2

(12) United States Patent
Noonan

(10) Patent No.: US 6,620,010 B2
(45) Date of Patent: Sep. 16, 2003

(54) BUOYANCY AID

(75) Inventor: Mary C. Noonan, New South Wales (AU)

(73) Assignee: Central Coast Capital Corporation, Santa Barbara, CA (US)

( * ) Notice: Subject to any disclaimer, the term of this patent is extended or adjusted under 35 U.S.C. 154(b) by 0 days.

(21) Appl. No.: 09/797,314

(22) Filed: Feb. 28, 2001

(65) Prior Publication Data

US 2002/0046689 A1 Apr. 25, 2002

Related U.S. Application Data

(60) Provisional application No. 60/186,051, filed on Feb. 29, 2000.

(51) Int. Cl.[7] ..... B63C 9/08

(52) U.S. Cl. ..... 441/106; 441/116

(58) Field of Search ..... 441/80, 106, 108, 441/111, 112, 116, 117, 118, 122, 123, 129

(56) References Cited

U.S. PATENT DOCUMENTS 1,297,270 A * 3/1919 Stebbing ..... 441/118
1,478,351 A * 12/1923 O'Shaughnessy ..... 441/118
1,559,059 A * 10/1925 Abbott ..... 441/121
1,850,660 A * 3/1932 Coppel ..... 441/118
2,675,143 A * 4/1954 Seemann, Jr. ..... 441/93
3,094,724 A * 6/1963 Lerner ..... 441/118
3,626,530 A * 12/1971 Ecklor et al. ..... 441/111
3,681,799 A * 8/1972 Smith ..... 441/112
3,736,610 A * 6/1973 Frieder, Jr. ..... 441/112
4,184,216 A * 1/1980 Saleen ..... 441/93
4,523,914 A * 6/1985 Faulconer et al. ..... 441/106
4,547,165 A * 10/1985 Scheurer et al. ..... 441/112
4,555,234 A * 11/1985 Kent ..... 441/106
4,887,987 A * 12/1989 Kato ..... 441/113
5,702,279 A * 12/1997 Brown ..... 441/108

* cited by examiner

*Primary Examiner*—S. Joseph Morano
*Assistant Examiner*—Lars A. Olson

(57) ABSTRACT

A buoyancy aid for use in the surf or water which does not restrict body movement is shown. The buoyancy aid also allows the individual or person to remain afloat in a substantial upright position. A buoyancy aid for maintaining the torso of a person in a substantially upright position in a water environment is also shown. The buoyancy aid in the preferred embodiment includes a fastening system including a chest fastening member and a waist fastening member to fit around the waist of an individual or person. The buoyancy aid also includes a buoyancy member formed of a buoyancy material having pair of spaced substantially planar "V"-shaped buoyant strips which are disposed to be substantially equal on the front and back of a torso of a person. The buoyancy member when coupled with the chest fastening member and the waist fastening member forms a harness which straddles the shoulders and waist, respectively, of an individual or person and maintains the torso in a substantially upright position in a water environment.

28 Claims, 7 Drawing Sheets

BUOYANCY AID

CROSS-REFERENCES TO RELATED APPLICATIONS

This Application claims the benefit under 35 USC 119 of Australian Application Ser. No. 15084/97 filed Mar. 4, 1997.

This Application claims the benefit, under Title 35, United States Code §119(e), of U.S. Provisional Patent Application Ser. No. 60/186,051 filed Feb. 29, 2000.

STATEMENT REGARDING FEDERALLY SPONSORED RESEARCH OR DEVELOPMENT

Not Applicable

REFERENCE TO A "MICROFICHE APPENDIX" (SEE 37 CFR 1.96)

Not Applicable

BACKGROUND OF THE INVENTION

1. Field of the Invention

The present invention relates to a buoyancy aid, for use in the surf or water, which does not restrict body movement and which also allows the individual to remain afloat in an upright position in water.

2. Description of the Prior Art

At present, more and more people are starting to enjoy swimming and bathing activities, particularly in warmer regions situated near the surf or other water bodies. It is apparent that there is a need for a buoyancy aid or buoyancy device that assists the user in the surf or water and which also does not restrict body movement.

Presently, conventional flotation devices have been designed to be used to help persons to swim, or for keeping someone afloat after they have been cast into the water in an emergency situation.

The first category of devices consists of floats which are strapped to the backs of an individual, generally a child, so as to help maintain the body in a substantially, horizontal position. Such devices also allow unimpeded movement of the arms, so as to not interfere when used in the instruction of swimming technique. This device, however, is not suitable for keeping the body in an upright position, which is the necessary disposition, when swimming in the surf.

The second category of devices consists of items such as life jackets and the like which are flotation jackets which assist an individual to stay afloat in the water when in an emergency situation. They are not used in swimming instruction as they are intentionally quite bulky and, as such, severely restrict arm movement in the water.

PRIOR SUMMARY OF THE INVENTION

The present invention seeks to overcome the disadvantages of the prior art by providing a buoyancy aid for use, by an individual or person, in the surf or other water environments.

The present invention also seeks to provide a buoyancy aid that allows the torso or a user to be biased towards a substantially upright position, when in the water, whilst also permitting movement of the arms and legs. The buoyancy aid can however be used in, swimming position, i.e. on one's stomach, back or side, or on a boogie board or the like.

In one broad form the present invention provides a buoyancy aid for maintaining the torso of a person in a substantially upright disposition in a water environment comprises:

a fastening member comprising a belt and a fastening device to fit around the waist of a person; and a buoyancy member comprising buoyant material adapted to be substantially disposed equally on the front and back of a torso of a person in a manner such that when coupled with the fastening member a harness is formed which straddles the shoulders of a person.

In a preferred form, the buoyancy member includes buoyancy strips which form a pair of laterally spaced apart strips and which are substantially V-shaped, Y-shaped or planar shaped.

In a preferred form, the buoyancy member is embodied as a pair of laterally spaced strips which are joined at each end of the harness to form a substantially Y-shape or V-shape.

Preferably, the fastening member also comprises a strap disposed normal to the belt which attaches to one end of the laterally spaced apart strips and to a fastening member.

Preferably, the belt of a waist fastening member contains a fastening device, such as a buckle.

Preferably, either the belt and/or a strap operatively connecting the buoyancy strip to the belt contains an adjusting member, so as to neatly secure the harness to a torso of a person.

Preferably, the buoyant material comprises compressed foam.

Preferably, the belt comprises nylon.

Preferably, the fastening device comprises a buckle. It is preferably formed of molded plastic.

Preferably, the strap is formed of similar material to the belt.

BRIEF DESCRIPTION OF THE DRAWING

The present invention will become more fully understood from the following detailed description of a preferred but non limiting embodiment thereof, described in connection with the accompanying drawings, wherein.

DETAILED DESCRIPTION OF THE INVENTION

Figure 1:
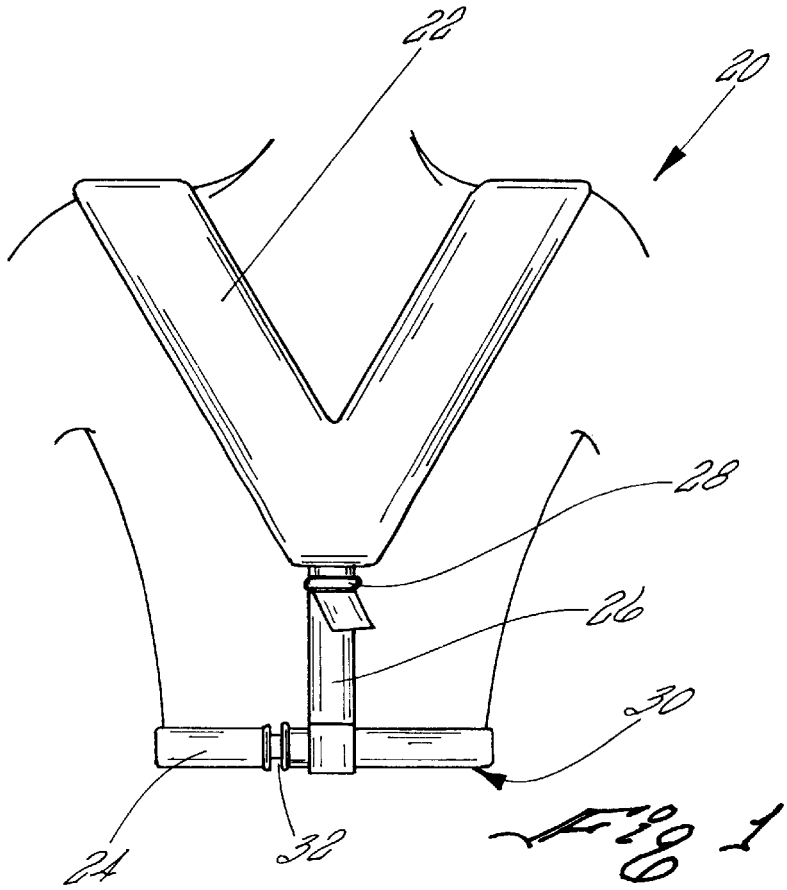
FIG. 1 shows a front elevational view of a person wearing a preferred embodiment of the invention.
Figure 2:
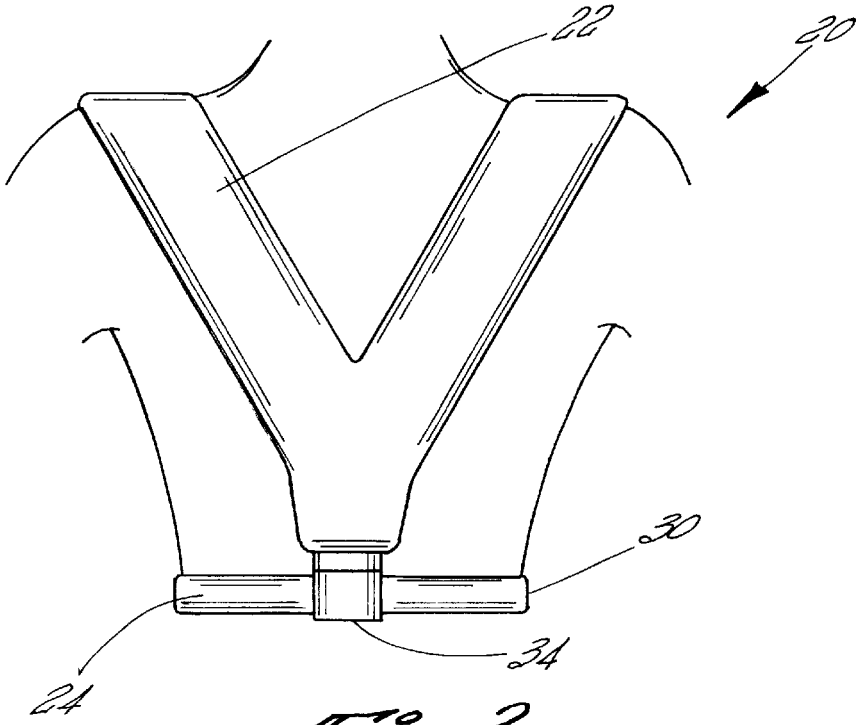
FIG. 2 shows a rear elevational view of a person wearing the buoyancy aid of FIG. 1.

The buoyancy aid, designated by the numeral 20, as shown in FIGS. 1 and 2, is embodied substantially in the form or design of a harness, which allows unconstricted movement of the arms. It is comprised of a buoyancy member having two laterally spaced apart strips of buoyant material 22 which are joined at the front in substantially a V-shape and joined at the back in substantially a Y-shape. It is designed to straddle the shoulders of a person or individual, as shown, and is to be secured in position by way of a fastening means or fastening member.

The fastening means or fastening member may comprise a waist fastening member shown generally as 30 having a belt 24 formed of any suitable material, such as nylon, and, a buckle 32, which is typically formed of molded plastic. The buckle 32 is adjustable so that the belt 24 can be neatly fitted to the particular waist size of the person or individual. Two straps and 26 and 34 are disposed substantially normally to the belt 30 and are attached to the end portion 36 of the substantially Y-shaped buoyant strip 22 and to the V-shaped buoyant strip 22 and the belt 24, respectively. The buoyancy strips 22, situated at the front of the harness, is preferably additionally provided with an adjustment member 28 associated therewith, for firmly and neatly securing the harness to an individual or person.

As shown in FIG. 1, the front V-shaped buoyancy strip 22 is attached to an adjusting member 28 which is operatively connected to a strap 26 having a loop adapted to receive and pass the belt 24 forming the waist fastening member 30. A buckle 32 is one form of a fastening member and holds the waist fastening member 30 snuggly against the waist of the individual or person wearing the buoyancy aid 20.

In FIG. 2, the Y-shaped buoyancy strip 22 forms the back of the buoyancy of the buoyancy aid 20 and terminates in an elongated end 36 which has a strap 34 operatively connected to elongated end 36. The strap 34 has a loop end to receive the belt 24 of the waist fastening member 30.

To secure the buoyancy aid 20 to an individual or person, the head of the wearer is placed between the two laterally spaced apart buoyant strips 22 such that the buoyant strips 22 straddle the shoulders of the individual, with the V-shaped and/or Y-shaped portions extending down the chest and back respectively. Buckle 32 of the waist fastening member 30 form a waistband which may then be fastened to fit around the waist of the individual or person and the adjustment member 28 is used to refine the fit.

Figure 3:
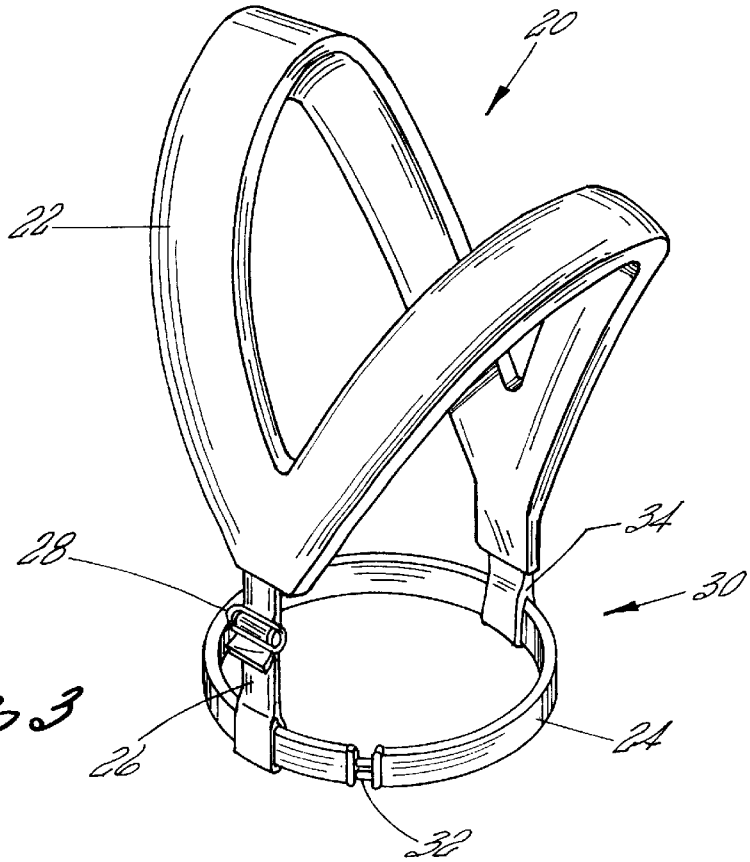
FIG. 3 shows a perspective view of the buoyancy aid of FIGS. 1 and 2.

FIG. 3 shows in a perspective view a stylized three-dimensional representation of the embodiment of the buoyancy aid 20 shown in FIGS. 1 and 2.

In FIG. 3, it is readily observable that the elongated end 36 of the Y-shaped buoyancy strip 22 is operatively attached by strap 34 to belt 24 of the waist fastening member 30. As such, in this embodiment, the Y-shaped buoyancy strip 22 forming the back is not adjustable in the same manner, as fastener member 28 is adjustable on the V-shaped buoyancy strip 22 forming the front.

It is envisioned that the elongated end 36 may be made to be shorter in length to accommodate a fastener similar to fastener 28 to provide the ability to adjust the back and front of the buoyancy aid 20.

It is also envisioned that both buoyancy strips 22 may alternatively be V-shaped and both be adjustable.

Figure 4:
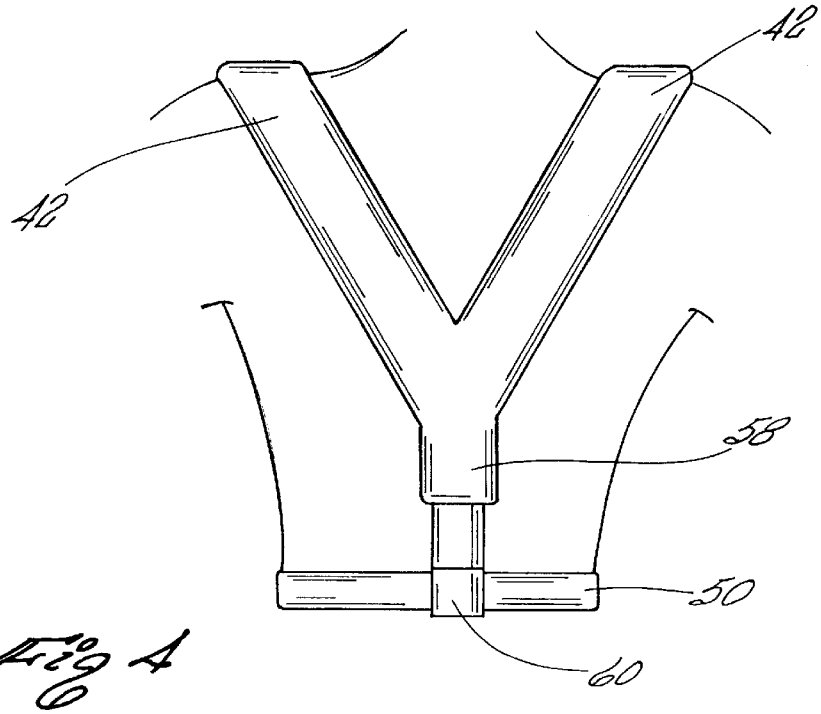
FIG. 4 shows a front elevational view of a person wearing another embodiment of a buoyancy aid using the teachings of this invention.
Figure 5:
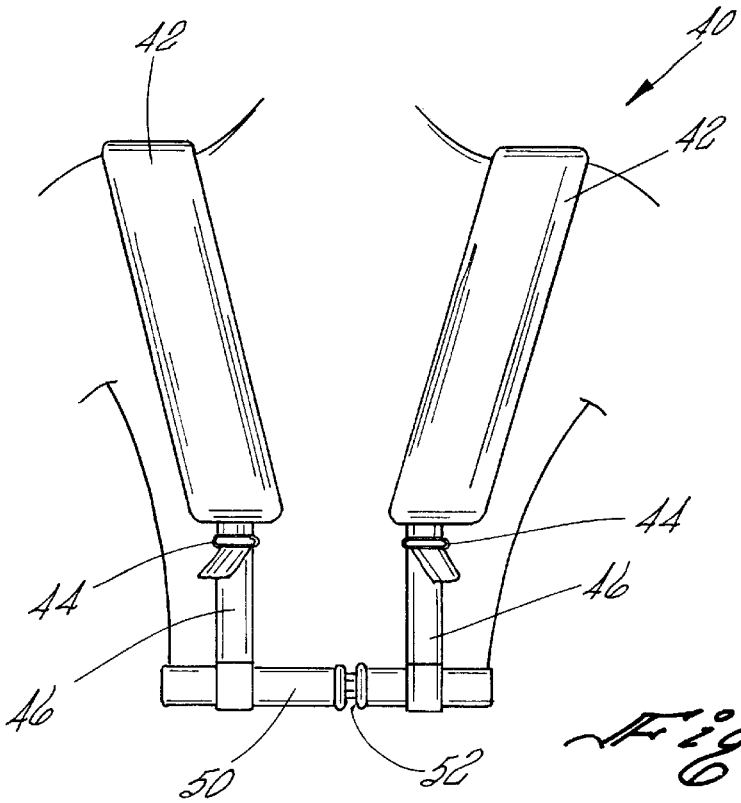
FIG. 5 shows a rear elevational of a person wearing the buoyancy aid of FIG. 4.

FIGS. 4 and 5 depict a further embodiment of the invention in which the two laterally spaced apart buoyancy strips shown as 42 do not, alternatively, join each other in a V-shape at the chest region of the individual. Rather, each buoyancy strip 42 is individually fastened to a belt 50 by a fastening member 44 and straps 46 each of which have loops to receive and pass belt 50. The belt 50 has a fastening member or adjusting member 52. In FIG. 5, the buoyancy strip 42 forming the back is Y-shaped having an elongated end 58. Elongated end 58 is operatively connected to strap 60 having an open loop to receive the belt 50.

Figure 6:
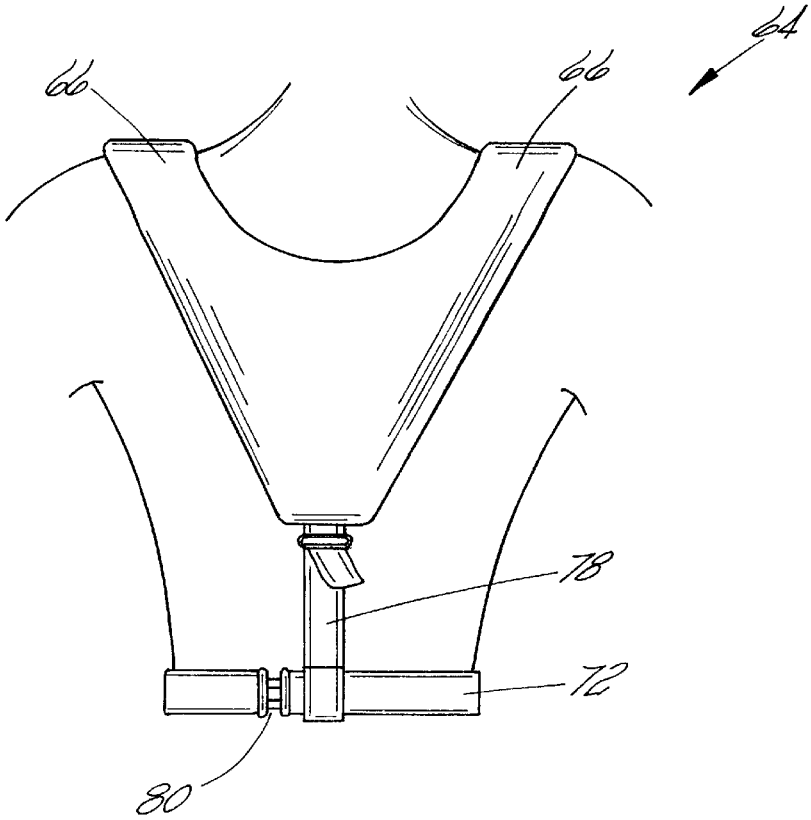
FIG. 6(A) shows a front elevational view of a person wearing yet another embodiment of a buoyancy aid using the teachings of this invention.
FIG. 6(B) shows a rear elevational view of the buoyancy aid of FIG. 6(A)
Figure 6B:
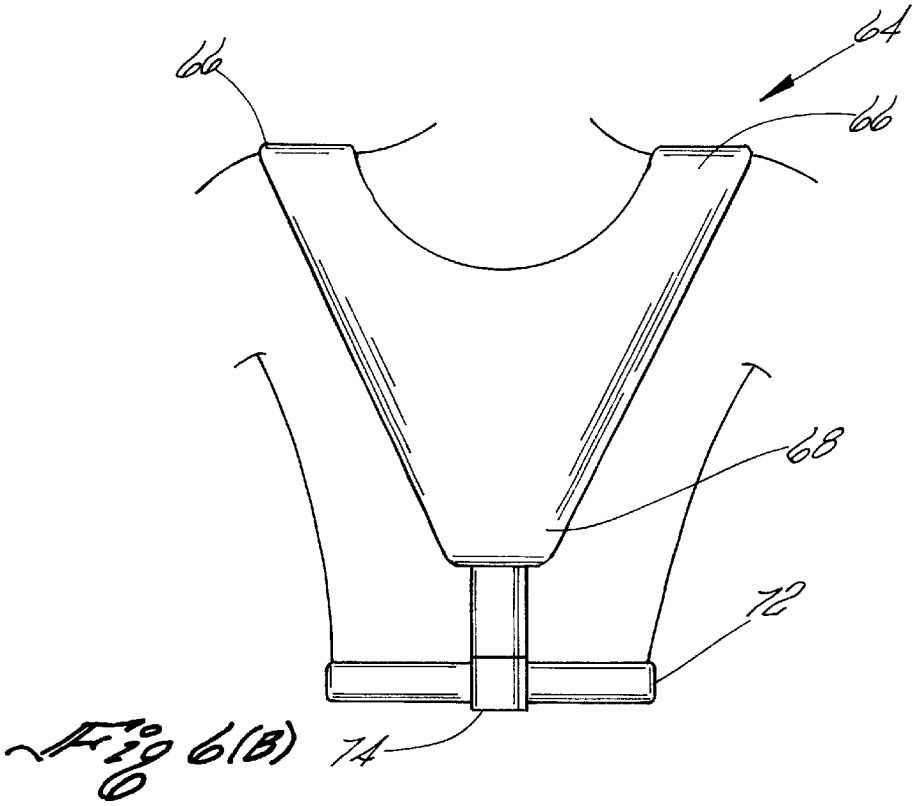

A variation of the buoyancy aid, as another embodiment, is shown in FIGS. 6(A) and 6(B). The buoyant material is still shown to be provided on the front and rear torso positions, but it is provided in either a Y-shaped or V-shaped strips 66.

In FIG. 6(A) and 6(B), the buoyancy material defines essentially a triangular-shaped buoyancy strip 66 having an opening 68 for passing the buoyancy aid 64 over the head of the person using the buoyancy aid 64.

In FIG. 6(A), the triangular-shaped buoyancy strip 66 has a fastener member 76 which is operatively connected to a strap 78. Strap 78 has a loop end for accessing the belt 72. A fastener member or adjustment member 80 is used to cause the belt 72 to removable fit around the waist of the user.

In FIG. 6(B), the triangular-shaped buoyancy strip 66 forming the back has an end 66 which is operable connected to a strap 74. Strap 74 has a loop end to receive and pass belt 72. In such an embodiment, it will be appreciated that the device still supports the torso in an upright position in a water environment whilst leaving the arms free and unobstructed.

Figure 7A:
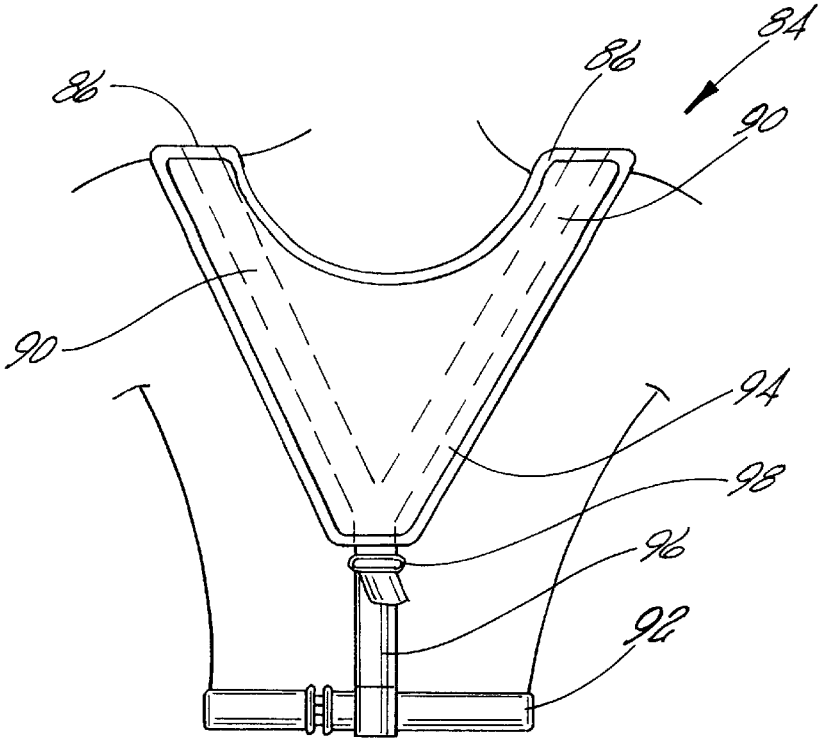
FIG. 7(A) shows a front elevational view of a person wearing still yet another embodiment of a buoyancy aid using the teachings of this invention.
Figure 7B:
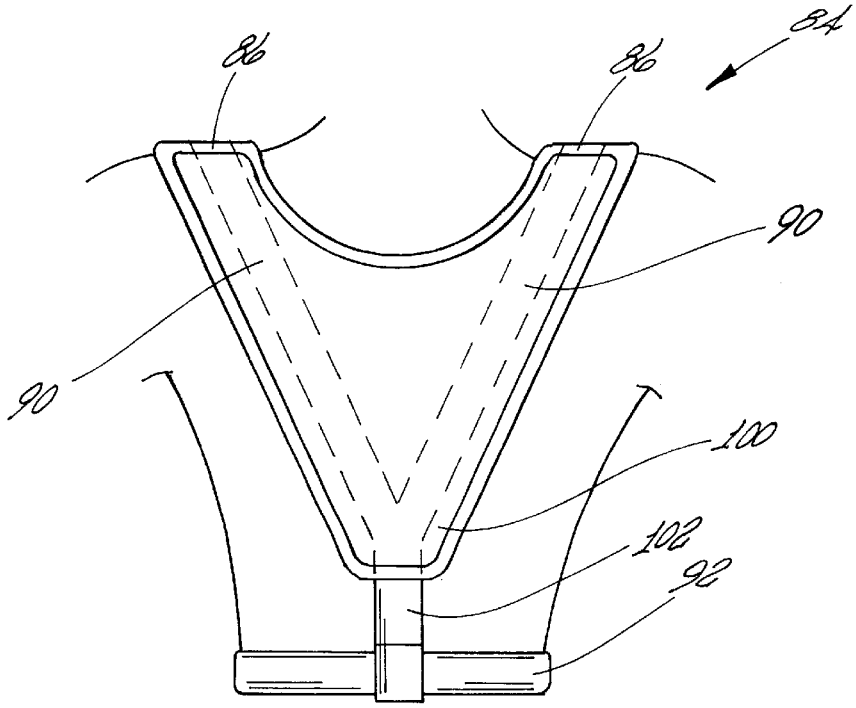
FIG. 7(B) shows a rear elevational view of the buoyancy aid of FIG. 7(A)

FIGS. 7(A) and 7(B) illustrates in still yet another embodiment that the buoyant member may be in the form of two substantially planar V-shaped buoyancy strips 86 to omit buoyancy material from the upper position of the shoulders, for less restricted body movement.

In the embodiment of FIG. 7(A), the planar V-shaped buoyancy strips 86 are attached by sewing or other known fastening techniques, such as for example, snaps, hooks, buttons and the like, to straps 90. The straps 90 are joined together at location 94 at the lower end of the buoyancy member 86 and have a fastener member 98 operatively connected thereto. A strap 96 has a loop for receiving and passing belt 92 thereby operatively and adjustably joining the buoyancy strips 86 to the belt 92. Belt 92 has a fastener member or adjusting member 100.

In FIG. 7(B), the planar buoyancy member 86 has two straps 90 which are formed together in area 104 and the strips 90 are operatively connected to strap 102. Strap 102 has a loop for receiving and passing belt 92.

Figure 8A:
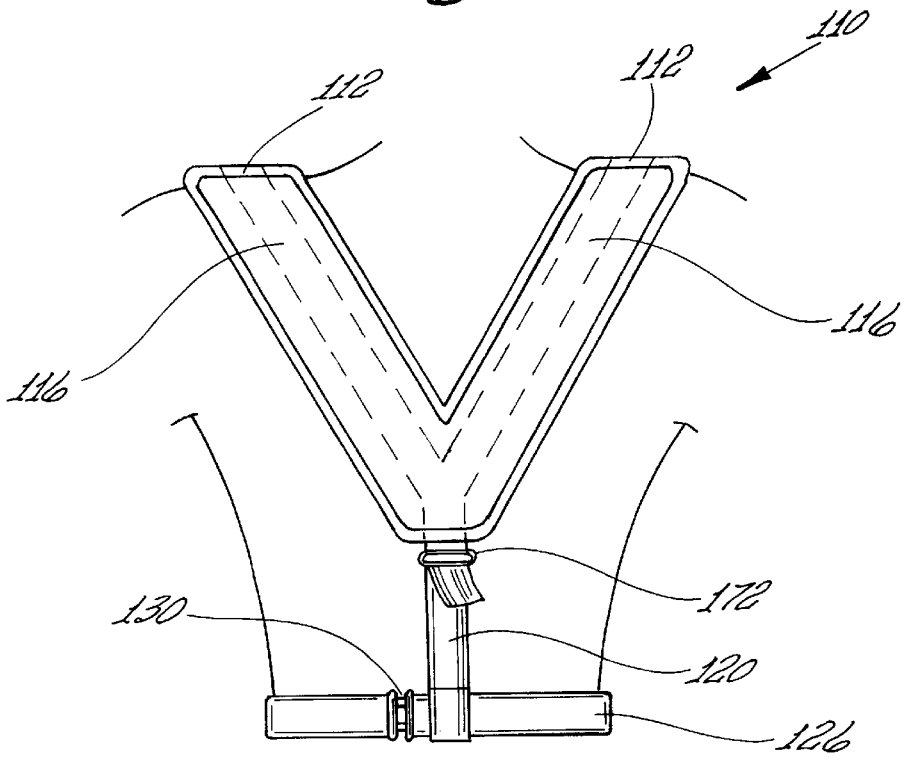
FIG. 8(A) shows an front elevational view of still yet another embodiment of buoyancy aid using the teachings of this invention.
Figure 8B:
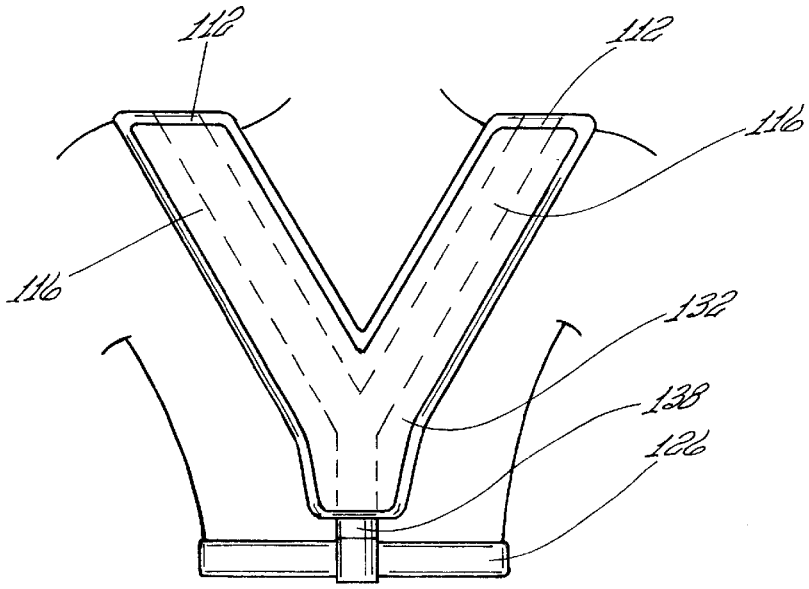
FIG. 8(B) shows an rear elevational view of the embodiment of FIG. 8(A)

FIGS. 8(A) and 8(B) show yet still another embodiment of a buoyancy aid 110 for maintaining the torso of a person in a substantially upright position in a water environment. The buoyancy aid 110 also includes a pair of spaced substantially planar "V"-shaped buoyant material strips 112 which are equally spaced on both sides and back of a torso of a person. The buoyancy aid 110 includes a chest fastening system shown generally as 126 which includes a fastening member 124 and a waist fastening member 130 having a belt 126 to fit around the waist of an individual or person. As such, the chest fastening system 122 and the waist fastening member 130 including belt 126 form a harness which straddles the shoulders and waist, respectively, of an individual or person and maintains the torso in a substantially upright position in a water environment.

FIGS. 8(A) and 8(B) show in detail the belting which may be provided through the harness device, to which the buoyant material may be overlaid. Alternatively, of course, if the buoyant material is of sufficient strength, then additional belting material need not be positioned but simply be attached to the extremities of the buoyant material.

Figure 9:
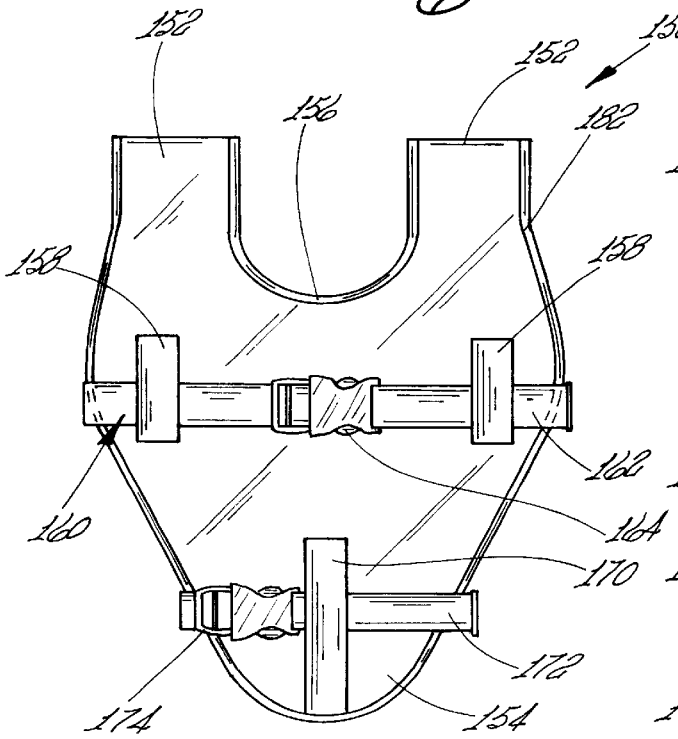
FIG. 9 is a front elevational view of an integrated buoyancy aid having a chest fastening member and a waist fastening member.
Figure 10:
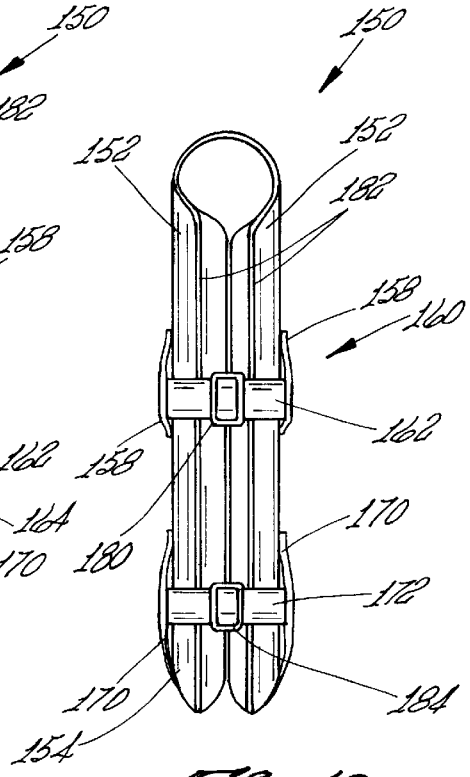
FIG. 10 is a right side elevational view of the integrated buoyancy aid of FIG. 9.
Figure 11:
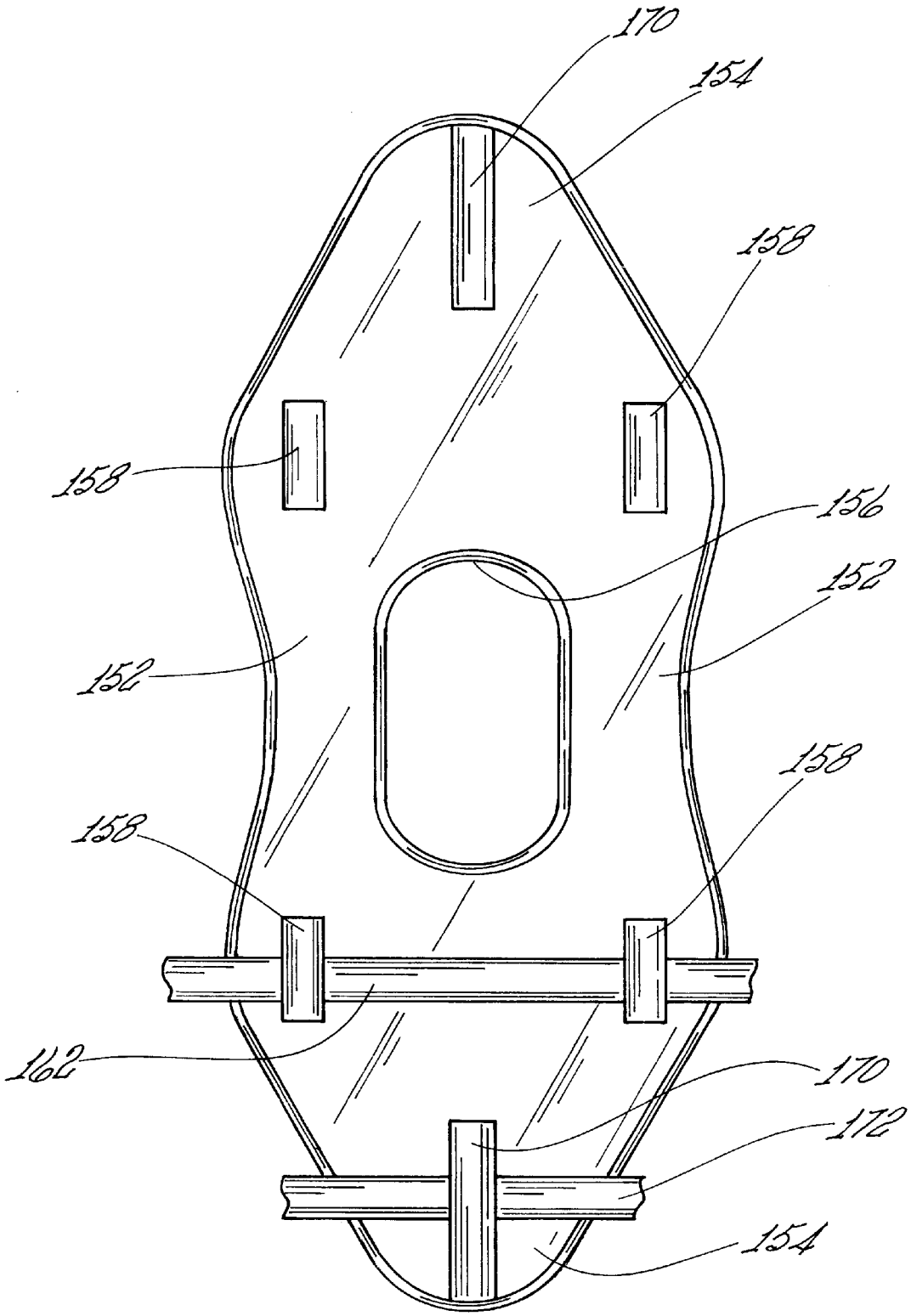
FIG. 11 is a top planar view of the buoyancy member utilized in the integrated buoyancy aid illustrated FIGS. 9 and 10.

FIGS. 9, 10 and 11 illustrate an integrated buoyancy aid 150 which is formed of a one-piece buoyancy member 152 having an elongated slot 156 formed therein to pass over the head of a user. The one-piece buoyancy member 152 is folded about its center so as to dispose the buoyancy material forming the buoyancy member 152 to be substantially equal on the front and back of a torso of the user. When the buoyancy member 152 is folded as depicted in FIGS. 9 and 10, a chest fastening member shown generally as 160 is held in place in the vicinity of the chest by support straps 158 which are in the form of loops. The chest-fastening member 160 includes a belt 162 and a fastening device 164, which in the preferred embodiment is an adjustable fastening member.

The support straps 158 receive and pass the belt 162 thereby holding the chest fastening member in place and which facilitates the fitting of the buoyancy aid to a torso of the user.

A waist fastening member shown generally as 168 is supported in place by strap 170 which is in the form of a loop. The waist fastening member 168 includes a belt 172 and a fastening device 174. The bottom portion of the buoyancy member 152, which bottom portion is shown as 154, is held in position in the vicinity of the waist of a user.

As depicted in FIG. 10, a strap support member 180 can be used to hold the strap 162 in place in the vicinity of the chest. In a similar manner, a strap support member 184 can be used to hold the strap 172 in place in the vicinity of the waist.

FIG. 11 shows the location or positions of the strap support members 158 and 170 in greater detail.

It is envisioned that the fastening members 164 and 174 may be buckles or may be a fastening device which includes the ability of adjusting the lengths of the belts to form a snug fit of the buoyancy aid 150 to the torso of a user.

The integrated buoyancy member 150 straddles the shoulders of an individual or person and maintains the torso of that individual or person in a substantially upright position in a water environment.

It will therefore be appreciated that the present invention provides a unique device that helps maintain an individual afloat in an upright position in the water, whilst still maintaining freedom of movement in the arms. It will be appreciated that various alterations and modifications to the actual shape or aesthetic, appearance of the buoyancy aid may be made without affecting the functional characteristics. All such variations and modifications should be considered to fall within the scope of the invention as broadly hereinbefore described and as claimed hereafter.

The preferred embodiment of the buoyance aid disclosed herein using the teachings of the present invention is exemplary. It is understood that uses, variations, modifications and the like may be made and all such uses, variations, modifications and the like are anticipated to be within the scope of this invention.

What is claimed is:

1. A buoyancy aid for maintaining the torso of a person in a substantially upright position in a water environment comprising:

a fastening member including a belt and a fastening device to fit around the waist of a person; and a buoyancy member including buoyant material which is to be disposed substantially equal on both the front and back of a torso in a manner such that when coupled with the fastening member a harness is formed which straddles the shoulders of an individual while spacing said buoyant material located on the front and back of the torso away from a neck of a user and maintains the torso in a substantially upright position in a water environment, said buoyancy member being formed to be substantially at least one of Y-shaped, V-shaped, triangular-shaped and planar-shaped wherein that portion thereof which forms the harness extending between the front and back of a torso further includes said buoyant material which straddles the shoulders of an individual.

2. The buoyancy aid of claim 1 wherein said fastening member includes a strap disposed normal to a belt which attaches one end of said buoyancy member to a waist fastening member.

3. The buoyancy aid of claim 1 wherein said fastening member includes a strap disposed normal to a belt which attaches one end of said buoyancy member to a waist fastening member.

4. The buoyancy aid of claim 3 wherein the belt comprises nylon.

5. The buoyancy aid of claim 3 wherein said waist fastening member includes a fastening device.

6. The buoyancy aid of claim 3 wherein said fastening device is a buckle.

7. The buoyancy aid of claim 3 wherein at least one of the belt and the strap contains an adjusting member so as to secure the harness to a torso.

8. The buoyancy aid of claim 1 wherein the buoyancy member comprises compressed foam.

9. A buoyancy aid for maintaining a torso of a person in a substantially upright position in a water environment comprising:

a fastening system including a chest fastening member and a waist fastening member having a belt to fit around the waist of a person; and a buoyancy member comprising a pair of spaced substantially planar buoyant material strips having a predetermined geometrical shape and adapted to be substantially equally spaced on both the front and back of a torso in a manner such that when coupled with the chest fastening member and the waist fastening member a harness is formed which straddles the shoulders and waist, respectively, of a person while spacing said buoyant material located on the front and back of the torso away from a neck of a user and maintains a torso in a substantially upright position in a water environment.

10. The buoyancy aid as claimed in claim 9 wherein at least one of said pair of spaced substantially planar buoyant material strips is substantially Y-shaped, V-shaped, triangular-shaped and planar-shaped.

11. The buoyancy aid of claim 9 wherein said chest fastening member includes a strap disposed normal to the belt which attaches one end of said buoyancy member to the waist fastening member.

12. The buoyancy aid of claim 11 wherein said strap also contains an adjustable fastening member.

13. The buoyancy aid of claim 9 wherein said waist fastening member includes a buckle.

14. A method for maintaining a torso of a person in a substantially upright position in a water environment comprising the steps of:

fitting around a torso of a person a buoyancy aid wherein the buoyancy aid includes a fastening member including a belt and a fastening device adapted to fit around the waist off a person and a buoyancy member including buoyant material which is to be disposed substantially equal on both the front and back of a torso in a manner such that when coupled with the fastening member a harness is formed which straddles the shoulders of an individual while spacing said buoyant material located on the front and back of the torso away from a neck of a user, said buoyancy member being formed to be substantially at least one of a Y-shaped, V-shaped, triangular-shaped and planar-shaped and wherein that portion thereof which forms the harness extending between the front and back of a torso further includes said buoyant material which straddles the shoulders of an individual; and fastening the fastening device around the waist of a person to so as to maintain the torso in a substantially upright position in a water environment.

15. The method of claim 14 wherein the step of fastening further includes the buoyancy member comprising compressed foam.

16. A method for maintaining a torso of a person in a substantially upright position in a water environment comprising the steps of:

fitting around a torso of a person a buoyancy aid wherein the buoyancy aid includes a fastening member including a belt and a fastening device adapted to fit around the waist of a person and a buoyancy member including buoyant material which is to be disposed substantially equal on both the front and back of a torso in a manner such that when coupled with the fastening member a harness is formed which straddles the shoulders of an individual while spacing said buoyant material located on the front and back of the torso away from a neck of a user, said buoyancy member being formed to be substantially at least one of Y-shaped, V-shaped, triangular-shaped and planar-shaped with that portion thereof which forms the harness extending between the front and back of a torso further includes said buoyant material which straddles the shoulders of an individual; and fastening the fastening device around the waist of a person to so as to maintain the torso in a substantially upright position in a water environment.

17. The method of claim 16 wherein the step of fastening further includes the buoyancy member comprising compressed foam.

18. A buoyancy aid for maintaining the torso of a person in a substantially upright position in a water environment comprising:

a fastening member including a belt and a fastening device to fit around the waist of a person; and a buoyancy member including buoyant material which is to be disposed substantially equal on both the front and back of a torso in a manner such that when coupled with the fastening member a harness is formed which straddles the shoulders of an individual while spacing said buoyant material located on the front and back of the torso away from a neck of a user and maintains the torso in a substantially upright position in a water environment, said buoyancy member being formed of a V-shaped buoyancy strip and a Y-shaped buoyancy strip.

19. The buoyancy aid of claim 18 wherein said buoyancy member comprises a pair of laterally spaced apart strips at least one of which is V-shaped and which are joined at each end to the harness.

20. The buoyancy aid of claim 19 wherein said buoyancy member comprises a pair of laterally spaced apart strips both of which are V-shaped and which are joined at each end at the harness.

21. The buoyancy aid of claim 18 wherein said buoyancy member comprises a pair of laterally spaced apart strips one of which is V-shaped and the other of which is Y-shaped and which are joined at each end at the harness.

22. The buoyancy aid as claimed in claim 18 wherein said buoyancy member comprises two separate buoyancy strips wherein one of said buoyancy strips comprise a pair of laterally spaced apart elongated buoyancy strip sections and the other of said buoyancy strips is Y-shaped and wherein each of said two separate buoyancy strips are joined at each end at the harness.

23. The buoyancy aid of claim 18 wherein said fastening member includes a strap disposed normal to a belt which attaches one end of said buoyancy member to a waist fastening member.

24. The buoyancy aid of claim 23 wherein said waist fastening member includes a fastening device.

25. The buoyancy aid of claim 24 wherein said fastening device is a buckle.

26. The buoyancy aid of claim 23 wherein at least one of the belt and the strap contains an adjusting member so as to secure the harness to a torso.

27. The buoyancy aid of claim 23 wherein the belt comprises nylon.

28. The buoyancy aid of claim 18 wherein the buoyancy member comprises compressed foam.

* * * * *